US006662970B1

(12) United States Patent
Presley

(10) Patent No.: US 6,662,970 B1
(45) Date of Patent: Dec. 16, 2003

(54) ON DEMAND OIL DISPENSING SYSTEM

(75) Inventor: Glen T. Presley, 2575 N. 80 W., Angola, IN (US) 46703

(73) Assignee: Glen T. Presley, Angola, IN (US)

( * ) Notice: Subject to any disclaimer, the term of this patent is extended or adjusted under 35 U.S.C. 154(b) by 57 days.

(21) Appl. No.: 09/685,178

(22) Filed: Oct. 11, 2000

Related U.S. Application Data

(60) Provisional application No. 60/172,457, filed on Dec. 17, 1999.

(51) Int. Cl.[7] ..... B67D 5/08

(52) U.S. Cl. ..... 222/63; 222/33; 222/71; 222/73

(58) Field of Search ..... 222/33, 63, 61, 222/73, 71

(56) References Cited

U.S. PATENT DOCUMENTS 1,599,081 A * 9/1926 Douglas ..... 222/63
1,960,389 A * 5/1934 McFerran, Jr. ..... 221/95
1,981,160 A * 11/1934 Baldwin ..... 137/79
2,788,916 A * 4/1957 Magann, Jr. ..... 222/17
2,813,661 A * 11/1957 Lazzereschi et al. ..... 222/63
3,318,479 A * 5/1967 Houle ..... 222/23
4,165,951 A * 8/1979 Friedman et al. ..... 417/26
5,228,594 A * 7/1993 Aslin ..... 222/63
5,402,913 A * 4/1995 Graf ..... 222/63
5,415,324 A * 5/1995 Coventry ..... 222/63
5,689,061 A * 11/1997 Seitter et al. ..... 73/40.5 R
5,769,134 A * 6/1998 Kenney et al. ..... 141/59

* cited by examiner

*Primary Examiner*—Gene Mancene
*Assistant Examiner*—Frederick Nicolas
(74) *Attorney, Agent, or Firm*—Edward L. Brown, Jr.

(57) ABSTRACT

An on demand oil dispensing system for motor vehicles including an electric motor driving a gear pump having flow paths including an intake line connected to an oil reservoir and a discharge line having a manual shut-off valve at the end thereof and a pressure sensing switch positioned in the discharge line which cuts off power to the motor and pump when the pressure in the discharge line rises above a set level and a reverse flow check valve in the discharge line upstream of the pressure sensing switch.

11 Claims, 1 Drawing Sheet

ON DEMAND OIL DISPENSING SYSTEM

This application claims the benefit of Provisional Application No. 60/172,457, filed Dec. 17, 1999.

BACKGROUND OF THE INVENTION

On demand oil dispensing systems have been in use for many years to dispense oil or other non-compressible fluid products. These systems are used to change fluids in vehicles, initial filling of new equipment and the general transfer of fluids. Up until the present time almost all of these systems have employed an air operated pumping system that consists of an air compressor to supply pressurized air, regulators and filters to control air pressure and to condition the air to remove moisture and contaminates from the air, an air operated pump to pump the fluid, plumbing to route the fluid to the desired location and a hose end valve or valve and meter to turn the system on and off or if a meter is used to turn the system on and off and to measure the fluid dispensed. The air pumps have consisted of a reciprocating air operated cylinder with the appropriate valving to produce the automatic reciprocating cylinder motion. The air pump is physically connected to a second cylinder that also reciprocates and is connected to the fluid source that pumps the fluid being dispensed. The second cylinder has the appropriate valving to function as a pump. The pressure that can be obtained on the fluid being dispensed is determined by the air pressure to the air cylinder and the ratio of the areas of the air cylinder and the fluid-pumping cylinder. For example, if the air pressure 100 psi is used and the area ratio of the cylinders is 5 to 1, the maximum fluid pressure would be 500 psi.

This system becomes a demand type system since when the fluid flow is blocked, the air pressure increases to the regulated pressure and the air cylinder stalls. When the pressure is relieved by opening a valve, the fluid pressure drops and the air pump reciprocates pumping fluid. This is a very desirable feature since the operator only opens or closes a valve to dispense fluid and the system produces flow on demand.

This type system also has many disadvantages which are as follows:

A large horsepower air compressor is required.

The air compressor and air pump both produce high noise levels.

The system is very inefficient due to the many conversions of power; electrical power is converted to pressurized air by the air compressor; the compressed air is converted to linear force by the air cylinder; and the linear force is converted to fluid pressure by the fluid cylinder. Each of these power conversions produce efficiency losses to the point that output power is less than 10% of input power.

This system is sensitive to any moisture or contaminants in the air that may cause sticking in the air pump valving or wear in the air cylinder due to moisture and contaminants.

The output fluid flow in this system is inversely proportional to the fluid pressure. At no outlet pressure the system produces maximum flow and at maximum outlet pressure the system produces zero flow.

The output flow and discharge pressure pulsated due to the reciprocating nature of the pump. Each time the cylinder reaches the end of the stroke and reverses directions, the output flow stops and the pressure drops. This causes pulsation in the system that is not desirable.

The installed cost of this type system is high due to the many components required to make a functional system. The need for a large air compressor if the air compressor is not required for other uses is a major cost.

The reliability of this type system is less than desirable due to the contamination sensitivity of the air pump valving, seal wear on the cylinder without lubrication and the many components required in the system.

SUMMARY OF THE INVENTION

The present invention eliminates the use of compressed air for the on-demand system. This system consists of an electric motor driven gear pump that is connected to the fluid source. The outlet of the gear pump employs a reverse flow check valve to trap pressure between the reverse flow check valve and the hose end shut-off valve. A pressure-sensing switch senses the pressure trapped in the system and, at a pre-set pressure, signals the electrical circuit to disconnect power to the electric motor to turn the pumping system off. When the hose end shut-off valve is opened, the pressure in the circuit drops below the pressure switch setting and electrical power is supplied to the motor starting the pump. As long as the hose end shut-off valve is open and the pressure is below the pressure switch setting, the pumping system stays on. When the hose end shut-off valve is closed, the pressure rises above the pressure switch setting and the system stops.

Since the electric motor is still rotating when the hose end shut-off valve is closed, a pressure relief valve must be connected to the pump outlet to prevent excessive pressure build up when the pump outlet is blocked. This relief valve serves two functions. First, the relief valve prevents excess pressure build up. Secondly, the relief valve allows a pressure higher than the pressure switch setting to be trapped in the system between the reverse flow check valve and the hose end shut-off valve. This is desirable since the pressure switch would signal the pump to turn on with a very small loss of pressure in the system due to thermal contraction of the fluid or any fluid leakage past the reverse flow check valve or the hose end shut-off valve. Since the electric motor is turning at normal operating speed, when the hose end meter is closed the motor has inertia which will continue to turn the pump after the hose end shut-off valve is closed and the pump will continue to pump fluid until the motor stops. Therefore, the pressure relief valve can be set at a pressure greater than the pressure switch setting to get a trapped pressure higher than the pressure switch setting.

It is also necessary to install a reverse flow check valve in the pump inlet. This check valve prevents fluid from draining from the pump when not running. This check valve assures the pump will prime instantly when started and also eliminates any air in the system that may cause error in the dispensing volume since air in the fluid system could cause error in the hose end meter reading.

Advantages of the present invention include:

Output flow is essentially constant with increased output pressure up to the pressure setting.

The output flow is continuous and non-pulsating.

The noise level of the pumping system is very low compared to the air operated systems.

System cost is much less than an air system due to fewer components and the elimination of an air compressor.

The system is many times more efficient than an air system. A 0.5 horsepower system will generate as much or more output horsepower as a 5 horsepower air driven system.

The system is more reliable since the problem of contaminated air is eliminated.

Installation cost is lower since air lines, air filters, air regulators and lubricators are not required.

The electrical operating costs are much lower due to system efficiency.

DESCRIPTION OF THE PREFERRED EMBODIMENT

Figure 1:
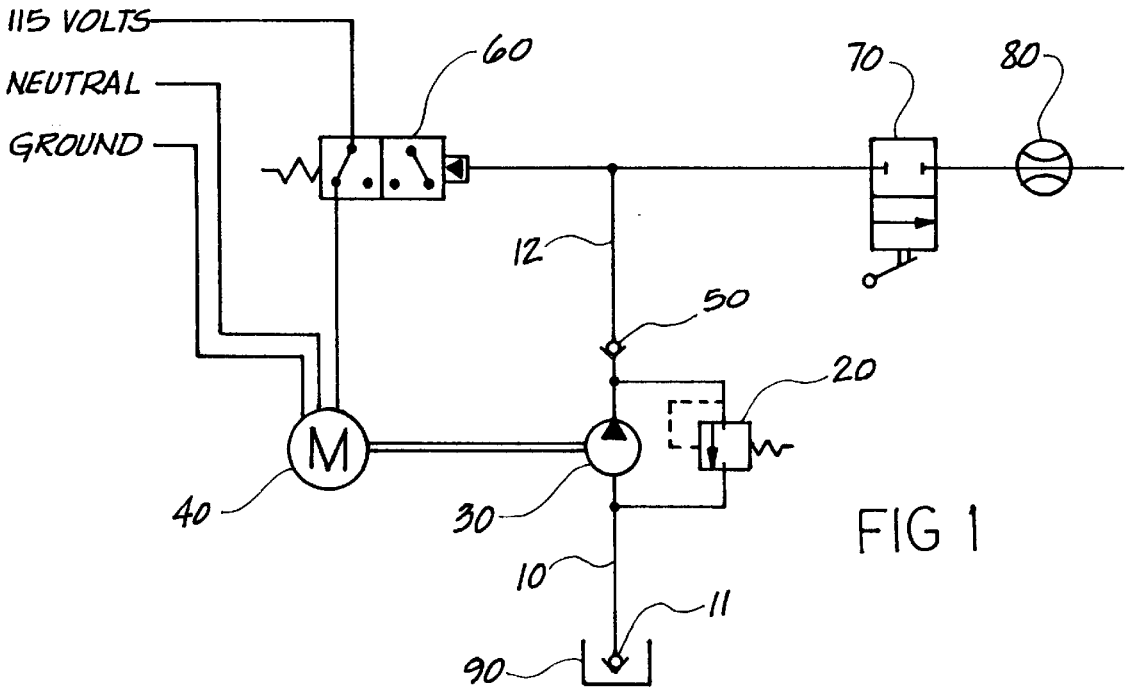
FIG. 1 shows a symbolic schematic of the present invention.

The improved system of the present invention consists of an electric motor 40 driving a gear pump 30. The pump 30 is mounted on a tank or reservoir 90 containing the fluid being pumped. The pump inlet line has a drop tube or suction pipe 10 that extends into the fluid. This drop tube or suction pipe 10 employs a check valve 11 that prevents fluid flowing out of the suction pipe when the pump isn't running so that the pump 30 is always full of fluid. The pump outlet line 12 is connected to a check valve 50 that prevents reverse flow in the outlet line 12. A pressure relief valve 20 relieves the outlet pressure to the inlet side of the pump 30 at a predetermined preset pressure. Down stream of the outlet check valve 50 is a normally closed pressure operated switch 60 which is installed to sense the pressure in the outlet line 12 down stream of the outlet check valve 50. A shut-off valve 70 is installed at the end of the dispensing hose to block flow in the closed position and allow flow through the shut-off valve 70 in the open position. Quite often a hose end meter 80 is installed at the end of the hose with the shut-off valve 70 to measure the flow being dispensed.

The pressure switch 60 consists of a piston that is subjected to pump outlet pressure on one end. The other end of the piston is biased toward the extended position by a spring. When the piston is subjected to a pressure creating a force toward the spring greater than the spring force, the piston moves toward the spring. Connected to the piston is an actuator plate that moves with the piston. When the actuator plate moves toward the spring, the actuator plate contacts the plunger on a normally closed switch and pushes the switch plunger in opening the switch circuit. A mechanical stop prevents the switch actuator from moving too great a distance to prevent mechanical damage to the switch. When the pressure force acting on the piston decreases below the spring force) the spring extends, moving the piston and piston actuator away from the switch plunger, allowing the spring loaded switch plunger to extend and close the switch circuit.

During normal operation of this system the shut-off valve 70 is closed and pressure greater than the pressure switch setting is trapped in the line 12 between the outlet check valve 50 and the shut-off valve 70. This opens the circuit in the pressure switch 60 and no electrical power is supplied to the electric motor 40 so the motor is at rest and there is no pumping. When the shut-off valve 70 is opened, the pressure trapped between the outlet check valve 50 and the shut-off valve 70 is relieved allowing the pressure switch to close the electrical circuit, thus supplying electrical power to the motor starting the motor 40 and driving the pump 30 and delivering fluid out the hose end meter 80. When the desired amount of fluid is dispensed, the shut-off valve 70 is closed causing the pressure to build in the pump outlet line 12. When this pressure reaches the pressure setting of the pressure switch 60, the switch opens breaking the electrical circuit to the motor. Due to the inertia of the electric motor 40, the inertia force will continue driving the pump 30 until the braking action of the fluid pressure acting on the pump overcomes the inertial force stopping the motor. To prevent the pressure generated by the inertia force from becoming too great and damaging system components, relief valve 20 is set to bypass flow to the inlet side of the pump at some pre-set pressure greater than the pressure setting of the pressure switch 60. The continued pumping action due to the inertia force is a desirable feature since this allows pressures greater than the pressure switch setting to be generated, thus a pressure higher than the pressure switch setting is trapped between outlet check 50 and the shut-off valve 70. This is desirable since any reduction in the trapped pressure due to thermal contraction or leakage through the outlet check valve 50 or the hose end shut-off valve 70 would cause the pressure switch to close the electrical circuit starting the motor. The difference between the pressure setting of the relief valve 20 and the pressure switch 60 can be set to give the best system performance.

Figure 2:
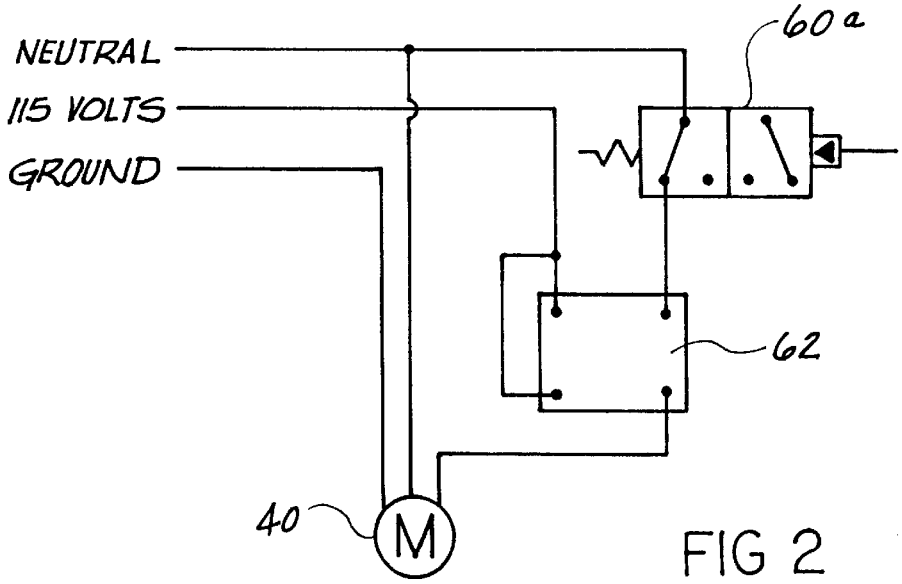
FIG. 2 illustrates an alternate design electrical circuit including a relay.

In the system described above, the full motor current would be carried through the switch in the pressure switch 60. With the size motors used in this system, the motor current could exceed 20 amps, and with the many operations desired, the switch sizes and cost could become excessive. FIG. 2 illustrates a circuit wherein the pressure switch 60*a* is used to operate a relay 62 to supply the electrical power to the motor, thus the switch in the pressure switch only has to carry the current required to operate the relay. There is another advantage using a relay to carry the motor current in that a solid state relay that has a zero voltage crossing circuit can be used. This allows the electricity to the motor to be switched off or on only when the voltage crosses zero. This reduces voltage spikes when the motor is turned on since at the instant the relay is engaged there will be no voltage applied through the relay.

I claim:

1. An on demand oil dispensing system comprising:

an electric motor supplied by a power line;

a gear pump driven by said electric motor having a flow path including intake and discharge lines;

an oil reservoir connected to the pump intake line;

a shutoff valve in the discharge line;

a pressure-sensing switch having a single operating point positioned in the discharge line upstream of the shutoff valve which cuts off the power to the motor when the pressure in the discharge line rises above a set level; and a reverse flow check valve in the discharge line upstream of the pressure-sensing switch.

2. An on demand oil dispensing system, as set forth in claim 1, including:

a pressure relief valve connecting the discharge line to atmospheric pressure when the discharge line pressure exceeds a certain pressure; and a flow meter positioned in the pump flow path for measuring specific flow through said pump.

3. An on demand oil dispensing system, as set forth in claim 1, including a second reverse flow check valve positioned in the intake line upstream of said pump.

4. An on demand oil dispensing system, as set forth in claim 2, wherein the shutoff valve is manually operated and is positioned in the end of the discharge line.

5. An on demand oil dispensing system, as set forth in claim 1, wherein the pressure relief valve is set at a pressure level above the level of the pressure-sensing switch whereby the pressure-sensing switch cuts off power to the pump prior to relieving pressure across the said pressure relief valve to tank.

6. An on demand oil dispensing system, as set forth in claim 1, further including an electrical relay which supplies electrical power to the motor, and the pressure-sensing switch actuates the relay which in turn supplies electrical power to the motor.

7. An on demand fluid dispensing system comprising:

an electric motor supplied by a power line;

a gear pump driven by said electric motor having a flow path including intake and discharge lines;

an oil reservoir connected to the pump intake line;

a shutoff valve in the discharge line;

a pressure-sensing switch having a single operating point in the discharge line positioned between the pump and the shutoff valve which cuts off the power to the motor when the pressure in the discharge line rises above a set level;

a reverse flow check valve in the discharge line between the pressure sensing switch and the pump;

a pressure relief valve means connecting the pump discharge line to the pump intake line opening flow across the pump to atmospheric pressure when the intake line pressure exceeds a certain pressure; and a flow meter positioned in the pump flow path for measuring specific flow through said pump.

8. An on demand oil dispensing system, as set forth in claim 7, including a second reverse flow check valve positioned in the intake line downstream of said pump.

9. An on demand oil dispensing system, as set forth in claim 7 wherein the shutoff valve is manually operated and is positioned in the end of the discharge line.

10. An on demand fluid dispensing system as set forth in claim 7, wherein the pressure relief valve is set at a pressure level above the level of the pressure-sensing switch whereby the pressure-sensing switch cuts off power to the pump prior to relieving pressure across the said pressure relief valve to tank.

11. An on demand fluid dispensing system as set forth in claim 7, further including an electrical relay which supplies electrical power to the motor, and the pressure-sensing switch actuates the relay which in turn supplies electrical power to, the motor.

* * * * *